US006728166B2

(12) United States Patent
Grupp

(10) Patent No.: US 6,728,166 B2
(45) Date of Patent: Apr. 27, 2004

(54) ELECTRONIC DEVICE FOR GENERATING AND DISPLAYING AN ITEM OF INFORMATION

(75) Inventor: Joachim Grupp, Enges (CH)

(73) Assignee: Asulab S.A., Bienne (CH)

( * ) Notice: Subject to any disclaimer, the term of this patent is extended or adjusted under 35 U.S.C. 154(b) by 444 days.

(21) Appl. No.: 09/854,552

(22) Filed: May 15, 2001

(65) Prior Publication Data

US 2001/0043513 A1 Nov. 22, 2001

(30) Foreign Application Priority Data

May 19, 2000 (CH) ..... 1011/00

(51) Int. Cl.[7] ..... G04C 17/00; G04C 19/00; G04B 37/00; A44C 5/00

(52) U.S. Cl. ..... 368/69; 368/88; 368/204; 368/281

(58) Field of Search ..... 368/69, 82–84, 368/204, 239, 281, 282, 242, 276, 88

(56) References Cited

U.S. PATENT DOCUMENTS

| | | | | |
|---|---|---|---|---|
| 4,178,751 A | * | 12/1979 | Liautaud | |
| 4,194,351 A | * | 3/1980 | Kume et al. | 368/82 |
| 4,229,936 A | | 10/1980 | Schneider et al. | |
| 4,280,212 A | * | 7/1981 | Ransom et al. | 368/82 |
| 4,518,267 A | * | 5/1985 | Hepp | 368/107 |
| 4,558,427 A | * | 12/1985 | Takeuchi et al. | 364/708 |
| 4,627,739 A | * | 12/1986 | Shingo et al. | 368/82 |
| 4,763,310 A | * | 8/1988 | Goetzberger | 368/205 |
| 4,779,249 A | * | 10/1988 | Rappaport | 368/276 |
| 5,020,039 A | * | 5/1991 | Yokote | 268/282 |
| 5,931,764 A | * | 8/1999 | Freeman et al. | 482/4 |
| 6,392,786 B1 | * | 5/2002 | Albert | 359/296 |

FOREIGN PATENT DOCUMENTS

| | | |
|---|---|---|
| DE | 90 04 197.6 | 6/1990 |
| DE | 198 25 533 | 12/1999 |
| EP | 785 527 | 7/1997 |
| GB | 2201266 | 8/1988 |

OTHER PUBLICATIONS

Patent Abstracts of Japan, vol. 009, No. 327, Dec. 21, 1985 & JP 60 151579, Aug. 9, 1985.
Patent Abstracts of Japan, vol. 006, No. 034, Mar. 2, 1985 & JP 56 151381, Nov. 24, 1981.
Patent Abstracts of Japan, vol. 001, No. 110, Sep. 26, 1977 & JP 52 043460, Apr. 5, 1977.
Patent Abstracts of Japan, vol. 010, No. 060, Mar. 11, 1986 & JP 60 20237, Oct. 12, 1985.

* cited by examiner

*Primary Examiner*—Vit W. Miska
(74) *Attorney, Agent, or Firm*—Sughrue Mion, PLLC

(57) ABSTRACT

The present invention concerns an electronic device for generating and displaying an item of information, including a flexible body (2) shaped to be able, for example, to be secured to a user's wrist, an electronic unit (18) for generating the information, at least a display cell (20) for displaying said information, and an electric power source (22) for powering the electronic unit (18), wherein the flexible body (2) has, at at least one location on its length, an overthickness of material forming a rigid receptacle (28) in the inner cavity of which is arranged said electronic unit (18).

22 Claims, 7 Drawing Sheets

ELECTRONIC DEVICE FOR GENERATING AND DISPLAYING AN ITEM OF INFORMATION

The present invention concerns an electronic device for generating and displaying an item of information.

A device of the aforementioned type essentially includes an electronic unit intended to provide an item of information, a display cell connected to the electronic unit for displaying the information, and an electric power source powering the electronic unit.

A device of this type may constitute, for example, an electronic timepiece with a digital or pseudo-analogue display. In this case, the electronic unit includes a time base circuit formed by an oscillator and a frequency divider, and counters which supply time-related information in response to signals provided by the time base circuit. The display cell is then arranged so as to display this time-related information which generally include at least the hour and minute of the current time. Very often the electronic unit and the display cell are arranged so that the second of the current time is also displayed, as well as other information such as, for example, the date, the day of the week, a measured time or an alarm time.

It will be evident upon reading the following description that the present invention is not limited to the case wherein the device is a timepiece, but that it can be adapted without any difficulty to any case wherein an item of information is generated by an electronic unit is to be displayed by a display cell.

Devices of this type which are known to this date generally include a rigid case, made of metal or plastic, in which are mounted the display cell, the electronic unit and the electric power source which is generally a battery. These elements are joined mechanically by a frame housed in the case, and they are electrically connected by connecting elements.

The case is generally closed by a back cover and a crystal through which the display cell is visible. Finally, manual control members such as, for example, pushbuttons, are often mounted on the case to allow various functions of the device to be controlled, such as the time setting function if the device is a timepiece.

Despite all the simplifications which have been made to the construction and manufacture of such devices, they are still quite complicated and thus are not able to be manufactured at a very low price. Further, the known devices are generally fragile and not water resistant, unless special measures are taken. These special measures of course increase the cost price of these devices.

Finally, these known devices are relatively heavy, in particular when their case is made of metal, and they have a substantial thickness.

In order to overcome these drawbacks, the Applicant has already proposed, in European Patent No. EP 0 138 098, a device of the type defined hereinbefore which is both inexpensive, of small thickness and flexible. This device includes three stacked flexible elements, namely an electronic unit for generating an item of information, a display cell for displaying this item of information, and an electric power source for powering the electronic unit. These three elements are mechanically connected and electrically connected to each other respectively by insulating adhesive materials and conductive adhesive materials.

The display cell is a liquid crystal cell which includes, in a conventional manner, two plates which delimit it and surround the liquid crystal layer. These two plates are formed by thin films of plastic material, for example a polyester or another polymer. Consequently, the cell is very thin, and it has a certain flexibility, which allows it to be deformed without being damaged and without ceasing to operate. Such a cell may have a total thickness of approximately 0.2 mm.

The electric power source is formed by a flat battery which includes a positive plate made of stainless steel, a negative plate made of zinc and an electrolyte, for example zinc perchlorate, contained in a porous separator arranged between the two plates. The plates and the electrolyte of this battery are arranged between two thin sheets of plastic material or cardboard which are welded or bonded to each other at their periphery. As all the components of the battery are very thin, the battery is also very thin. It may have a thickness of less than 1 mm. Such a battery has a certain flexibility and can be deformed without ceasing to operate.

Finally, the electronic unit includes a printed circuit including a flexible insulating substrate on which are deposited conductive paths. The electronic unit further includes an integrated circuit and a piezoelectric resonator. The integrated circuit may be arranged so as to perform, for example, time measuring functions. The electronic unit is very thin. The substrate has a thickness of 0.2 to 0.3 mm, and the integrated circuit and the resonator have thicknesses of approximately 1.5 mm. Since the substrate is flexible, so is the electronic unit.

The display cell is applied against the top face of the electronic unit, and the electric power source is applied against the bottom face of the electronic unit. These three elements are mechanically connected and electrically connected to each other respectively by insulating and conductive adhesive materials. The device thus formed is very thin. As all the elements are flexible and the layers of adhesive are extremely thin, the device is itself flexible and can be deformed without ceasing to operate. One may, for example, give this device the general shape of a wristband and provide, at the ends thereof, clasp means. As a result of the flexibility of the sheets of plastic material and/or cardboard which form this device, it may be worn like a conventional wristwatch.

A portable device including a flexible display cell and a wristband which forms the body of the device is also known from International Patent Application No. WO 99/67702. The wristband allows the device to be secured for example around a person's wrist. The portable device includes light flexible elements which allow it to match the shape of a given contour and to have a flat profile. The device can undergo the deformations to which a watch, for example, is subjected during normal physical activity, without being damaged. A clasp system made of a flexible polymer material is overmoulded onto the wristband.

The portable device may present information by means of the flexible display cell and a thin flexible piezoelectric loudspeaker. It may receive information via data input keys. The piezoelectric loudspeaker/microphone also allows the device to receive acoustic data. The portable device can communicate with external devices such as a computer or a smartcard reader via a communication element. This communication element may be an inductive loop deposited by screen printing inside the body of the device. The device may include an electric power source such as a flat lithium battery.

More precisely, the portable device includes top and bottom protective layers and spacers. The display cell is coated with a transparent material such as PVC. By molding or machining, the protective layers are given the necessary shape for receiving the internal components. These internal components include an integrated circuit mounted on a flexible printed circuit. The integrated circuit may include a microprocessor. The flexible display cell can be made using different materials. According to one embodiment, transparent electrodes are deposited on the inner faces of the top and bottom protective layers. The electrodes are shaped so as to provide a dot-matrix display or digit display. The display cell is formed of a liquid crystal display film which is a bi-stable or multi-stable material maintaining the displayed image even when the electric power supply is cut.

The microprocessor of the integrated circuit activates a control circuit which supplies the voltages necessary to activate and deactivate the pixels of the display cell. The electric power source arranged inside the portable device or an external power source (for example a smartcard reader) supplies the power necessary for the microprocessor and other elements to operate. The portable device can receive control pulses via data input keys. These keys which are dome-shaped, are laminated between the inner and outer protective layers of the portable device. Regions located directly below the data input keys are laminated inside with a rigid material to increase the reliability of said keys and to improve the reaction to the touch.

The devices of the type described hereinbefore have the particular advantage of being both flexible and of small thickness. Their main drawback lies however in the fact that certain of the components which form them are very fragile. This is true in particular for the integrated circuits which include, in a conventional manner, a silicon plate in which are formed the various electronic components necessary for performing the desired electronic function or functions. These silicon plates are coated with a protective layer generally made of glass. When a device of the aforementioned type constitutes, for example, an electronic timepiece, it further includes a quartz resonator element encapsulated in a ceramic or glass case. These various components are thus rigid and liable to be damaged or to cease operating when the device to which they are fitted is deformed to be able, for example, to be secured to a user's wrist. The electric connections which connect between them the battery, the integrated circuit, the display cell and the quartz resonator in the event that the device is a timepiece, are also extremely fragile and are liable not to withstand the deformations to which a watch, for example, is subjected during normal physical activity.

The main object of the present invention is thus to overcome the drawbacks of the aforementioned prior art in addition to others by providing an electronic device of the type defined above which is both inexpensive, light, water resistant and especially not fragile.

The present invention thus concerns a device for generating and displaying an item of information including a flexible body which can, for example, be given the shape of a wristband to be able to be secured to a user's wrist, an electronic unit for generating the information, a display cell for displaying said information, and an electric power source for supplying the electronic unit, characterised in that the flexible body has, at at least one location on its length, an overthickness of material forming a rigid receptacle in the inner cavity of which is arranged said electronic unit.

As a result of these features, the present invention provides an electronic device which is formed solely of a flexible body which can be given, for example, the shape of a wristband which is thicker and more rigid at its middle and flexible and thin towards its ends. Such a flexible body thus fulfils the two conventional functions of a wristwatch which are the protection of the most fragile components and the securing of the watch around its user's wrist. Indeed, when the device according to the invention constitutes an electronic timepiece, the fragile electronic components such as the integrated circuit, the quartz resonator element or even the battery which form it are housed in the thick portion of the flexible body which they contribute to making more rigid. These components are thus sheltered from dust, water or humidity, and can withstand the mechanical stress to which the flexible body is subjected when it is deformed to be able to fit a given profile without being damaged or ceasing to operate. Likewise, the problem of the electric connections which connect between them the components described above is also resolved insofar as these components and the conductive paths which connect them are arranged in the rigid volume of the flexible body. A reliable electric connection is thus obtained between the different components which constitute the device according to the invention.

According to another feature, the electric power source is also arranged in the rigid receptacle.

According to another feature of the invention, the flexible body includes in succession a flexible reinforcing layer forming the bottom of the electronic device, in which is arranged the receptacle intended to accommodate the electronic unit and the electric power source, a flexible printed circuit having a bottom face and a top face respectively turned towards the reinforcing layer and towards the top of the electronic device, the electronic unit and the electric power source being secured to the bottom face of the flexible printed circuit, while the display cell is arranged on the top face of said flexible printed circuit, and a flexible protective layer covering the flexible printed circuit.

Thus, the present invention has the form of a strip of very small thickness at one location on the length of which there is an overthickness forming a rigid cavity in the volume of which are housed the fragile electronic components. The entire length of the strip can thus be used for the display of information or decorative patterns which may change if required.

Other features and advantages of the present invention will appear more clearly upon reading the following detailed description of an example embodiment of the electronic device according to the invention, this example being given purely by way of non-limiting illustration, in conjunction with the annexed drawings, in which.

The present invention proceeds from the general inventive idea which consists in making an electronic device intended to generate and display an item of information in the shape of a flexible strip of very small thickness which has at at least one location on its length an overthickness of material forming a rigid receptacle in the inner cavity of which are arranged the fragile electronic components and, if required, an electric power source.

As a result of this feature, the electronic components and the electric connections which connect these components to each other are sheltered in particular from the mechanical stress to which the electronic device according to the invention is subjected when it is deformed so as to be able to fit the profile of a given contour.

The present invention will be described with reference to the case wherein the electronic device constitutes a timepiece of the wristwatch type. It goes without saying that the invention is not limited to this single embodiment and that it could apply to any case wherein an item of information is generated by an electronic unit, then displayed by a display cell.

Figure 1:
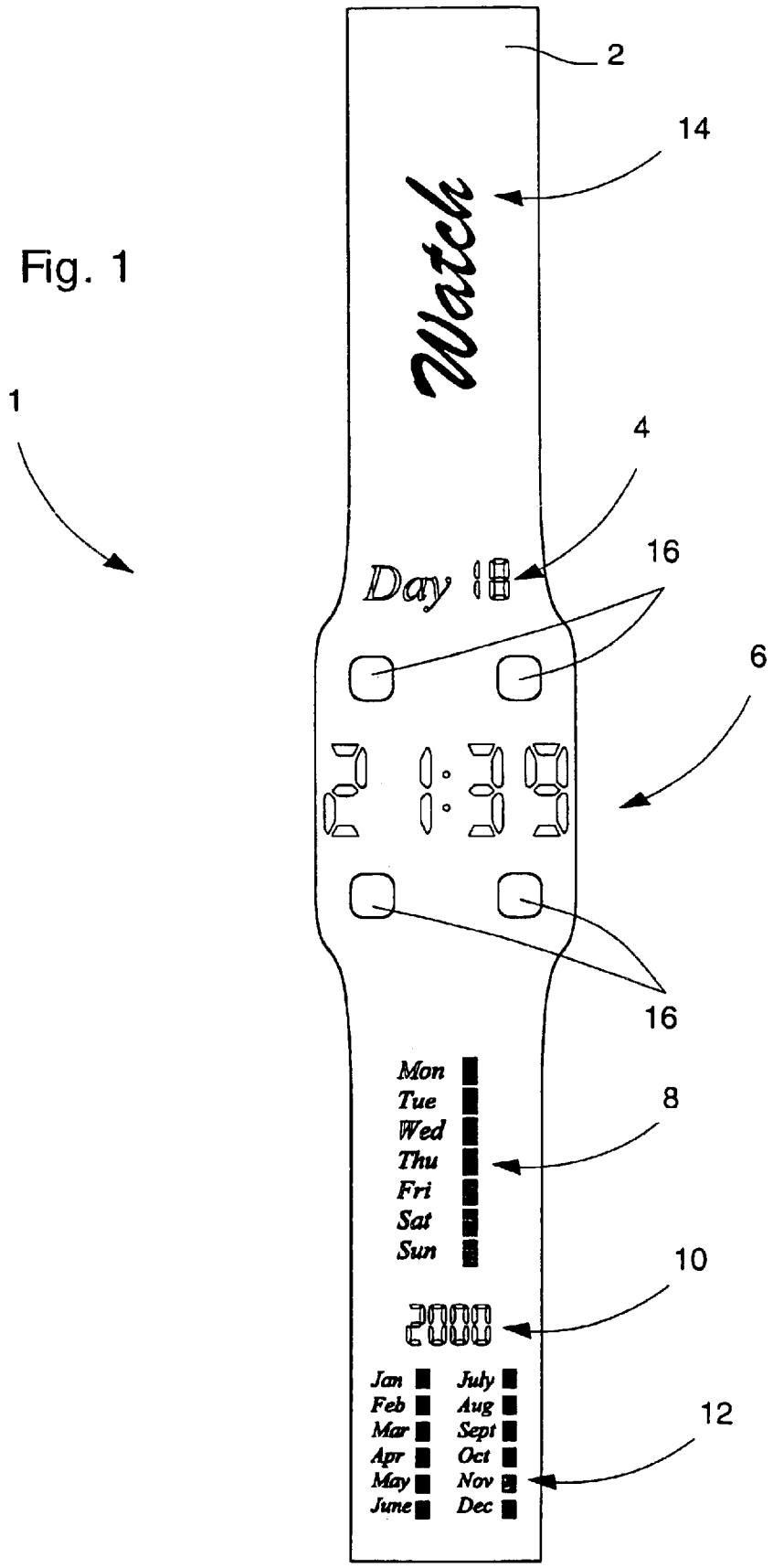
FIG. 1 is a top view of a wristwatch according to the present invention.

The wristwatch according to the invention is shown schematically in FIG. 1 and designated in this example by the general reference numeral 1. It includes a flexible body 2 which takes the form of a substantially rectilinear strip intended to be secured for example to a user's wrist. This strip 2 is flat and extremely thin as will be described in detail hereinafter. Wristwatch 1 includes several variable display zones designated respectively by the references 4, 6, 8, 10 and 12. Display zone 4 allows the date to be displayed, while display zone 6 allows the hour and the minutes of the current time to be displayed. Display zones 8, 10 and 12 indicate the day of the week, the year and the month of the year respectively. It will be noted that, according to an important advantage of the present invention, the entire length of flexible body 2 may be used to display this variable information. Of course, the present invention is not limited by the number or the nature of the information displayed. One may thus envisage also displaying a measured time or an alarm time. Wristwatch 1 also has a display zone 14 reserved for the display of a fanciful denomination or any other decorative pattern. The display in zone 14 may be fixed, for example printed on flexible body 2, or may also able to be variable. Wristwatch 1 includes finally means 16 for manually modifying the information to be displayed. In the example shown in FIG. 1, these means 16 are four in number. They are touch sensitive keys such as capacitive keys which the wearer of watch 1 touches lightly to enter information. The operating mode and activation of these touch sensitive keys will be described hereinafter in the text of the present description.

Figure 2:
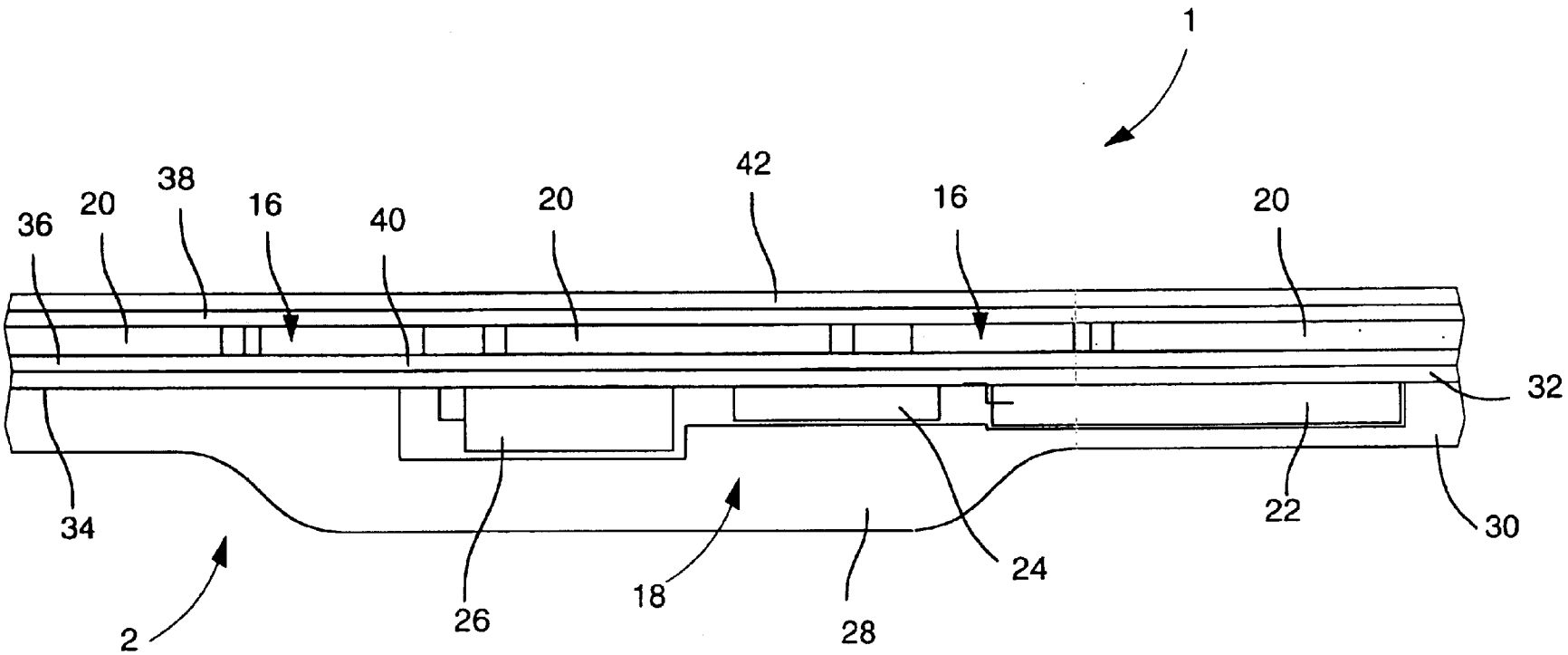
FIG. 2 is a longitudinal cross-section in the wristband of the watch shown in FIG. 1, at the location where the wristband has an overthickness of material forming a cavity in the inner volume of which are housed the fragile electronic components.

It will be noted that, in FIG. 2 and the following Figures, the various elements forming wristwatch 1 have been shown with thickness arbitrarily selected to be large in order to simplify understanding of the drawing.

FIG. 2 is a longitudinal cross-section of watch 1 of FIG. 1. As can be seen in this figure, wristwatch 1 includes an electronic unit 18 for generating the information to be displayed, a plurality of display cells 20 for displaying said information and an electric power source 22 for powering electronic unit 18. As the electronic device, in the present case, is a timepiece, electronic unit 18 includes an integrated circuit 24 and a quartz resonator circuit 26. Integrated circuit 24 is arranged to perform the desired time measuring functions. It contains in particular, a quartz oscillator circuit and a frequency divider intended to be connected to resonator 26 to constitute the time base circuit of wristwatch 1. Electronic unit 18 also includes counters which supply integrated circuit 24 with time-related information in response to the signals supplied by the time base.

The various electronic circuits made in integrated circuit 24 will not be described here since they are entirely conventional and have no bearing on the present invention. These electronic circuits are also different depending upon the type of information which the device according to the invention has to elaborate and display. Resonator 26 could also not exist, or be replaced by one or more other components, such as a temperature, pressure sensor or the like.

Integrated circuit 24 includes, in a conventional manner, a silicon plate in which are formed the various electronic components, mainly transistors. The silicon plate is coated with a protective layer generally made of glass or plastic, while keeping this component thin.

Quartz resonator 26 is encapsulated in a case, for example made of glass or a ceramic material, also in a conventional manner.

In accordance with the main feature of the invention, flexible body 2 has, at a location on its length, an overthickness of material forming a rigid receptacle 28 in the inner cavity of which are arranged integrated circuit 24 and quartz resonator element 26. In this manner, integrated circuit 24 and quartz resonator element 26 are sheltered from water, damp and dust and are thus not liable to be damaged or to cease to operate via the effect of the mechanical stress to which flexible body 2 is subjected when the latter is deformed to fit the profile of a given contour.

As is clear from FIG. 2, flexible body 2 includes a reinforcing layer 30 forming the back cover of wristwatch 1. In the reinforcing layer 30 is arranged rigid receptacle 28 intended to accommodate integrated circuit 24 and quartz resonator element 26. As is seen in the figure, receptacle 28 creates locally an overthickness of material and thus projects from the bottom face of reinforcing layer 30 which is turned towards the user's wrist around which wristwatch 1 according to the invention is secured. Receptacle 28 is made in a single piece with reinforcing layer 30 which, as will be seen hereinafter, is made of a flexible material. Consequently, it is the thickness of the layer of material forming receptacle 28 which gives the latter its rigidity. This rigidity is further improved by the presence of integrated circuit 24 and resonator 26 in the inner volume of said receptacle 28.

Flexible body 2 also includes a printed circuit 32 which includes a flexible insulating substrate on which conductive paths are deposited. This printed circuit 32 has a bottom face 34 and a top face 36 turned respectively towards reinforcing layer 30 and towards the top of wristwatch 1. Integrated circuit 24, resonator element 26 and electric power source 22 are secured to bottom face 34 of printed circuit 32, for example by means of a surface mounted device method (SMD). Display cells 20 are arranged on top face 36 of printed circuit 32.

Display cells 20 are preferably liquid crystal cells. According to a first embodiment, these liquid crystal cells each include two plates which delimit them and surround the liquid crystal layer, these two plates being formed by thin films of flexible plastic material. Film 38 forming the top face of each cell 20 is of course transparent, while the other film 40 may be transparent or opaque, depending on the particular case. Display cells 20 include, in a conventional manner, electrodes which are arranged on the inner faces of the two films 38, 40 of plastic material. On film 40, the electrodes each have the shape of one of the display elements which have to be made visible or invisible to form the various figures, letters or other signs which have to be displayed. These electrodes are commonly called control electrodes. The other film 38 generally only has one electrode which is located facing all the control electrodes and which is commonly called the counter-electrode. One may also envisage forming a set of elongated control electrodes on the other film, superposed to the control electrodes, in order to create a dot-matrix display device intended to form the desired variable display symbols.

According to a second variant, display cells 20 are of the polymer dispersed liquid crystal type (PDLC). Such cells may conventionally be formed of two plates which delimit them and which surround the liquid crystal layer. However, unlike conventional liquid crystal cells, the PDLC cells do not use polarisers. Moreover, according to an advantageous variant, one may envisage using printed circuit 32 as a substrates for the PDLC cells. In this case, only a transparent flexible film forming the top face of each cell 20 is necessary. The control electrodes are then deposited directly on printed circuit 32.

According to a third variant, display cells 20 are formed by layers of electronic ink deposited by screen printing on flexible printed circuit 32. This electronic ink is formed of capsules which are dispersed in a binder and which enclose a liquid crystal or an electrophoretic material. The control electrodes are deposited on printed circuit 32, while the counter-electrodes may, if so desired, be deposited directly on the layers of electronic ink or be printed on a thin sheet of flexible plastic material which is then bonded onto the electronic ink layers. This latter embodiment will be examined in more detail with reference to FIGS. 4A to 4E.

In the example shown in FIG. 2, electric power source 22 is arranged in the thin portion of reinforcing layer 30. It may, for example, be a flat lithium battery which includes a positive plate, a negative plate and an electrolyte arranged between the two plates. The plates and the electrolyte of this battery are arranged between two thin sheets of plastic material or cardboard which are welded or bonded to each other at their periphery. These sheets, these plates and this electrolyte have not been shown separately to avoid overloading the drawing unnecessarily.

FIG. 2 also shows two of touch sensitive keys 16 with which wristwatch 1 according to the invention is provided. These touch keys 16 allow the user of watch 1 to correct or modify the information displayed manually. For this purpose, integrated circuit 24 is arranged so as to perform a time-setting function in response to signals applied to those of its terminals which are connected to touch keys 16. This time-setting circuit, which will not be described in detail here, is able to select one of the items of information displayed and to modify the information selected in response to a number and/or the duration of the contact between the user's finger and one of touch keys 16.

Finally, a protective layer 42 is deposited on display cells 20. This protective layer 42 is formed of a film of flexible material which can, if required, bear decorative designs and which has to be transparent at least in those regions where it covers display cells 20.

It will be noted that flexible printed circuit 32 is secured to reinforcing layer 30 by means of a thin adhesive film or by means of a thin layer of liquid adhesive material, while the protective layer is bonded or hot pressed onto said printed circuit 32. The adhesive material, which may thus be liquid or paste-like, is intended to be transformed by a suitable treatment into a solid insulating adhesive and is deposited, by screen printing, for example, over the whole of bottom and top faces 34 and 36 of printed circuit 32. This material may be formed, for example, by mixing of an epoxy resin and its hardening agent in the proportions recommended by the manufacturer. The assembly thereby formed is then placed in the conditions necessary for the liquid or paste-like material to transform into solid insulating adhesive material. These conditions will depend on the nature of the adhesive material. It is evident that this adhesive material must be selected so that the conditions for it to harden are such that they do not cause the destruction of one or other of the various elements of wristwatch 1.

Flexible body 2, i.e. the different layers which form it (reinforcing layer 30, printed circuit 32 and protective layer 42) may be made of at least one of the following flexible materials: cardboard, paper or plastic. In the particular case of plastic, one could choose from among at least one of the following materials: ABS, polyamide, polycarbonate, polyester, polyethylene terephtalate, polyimide, polypropylene, polyurethane or silicon.

Figure 3:
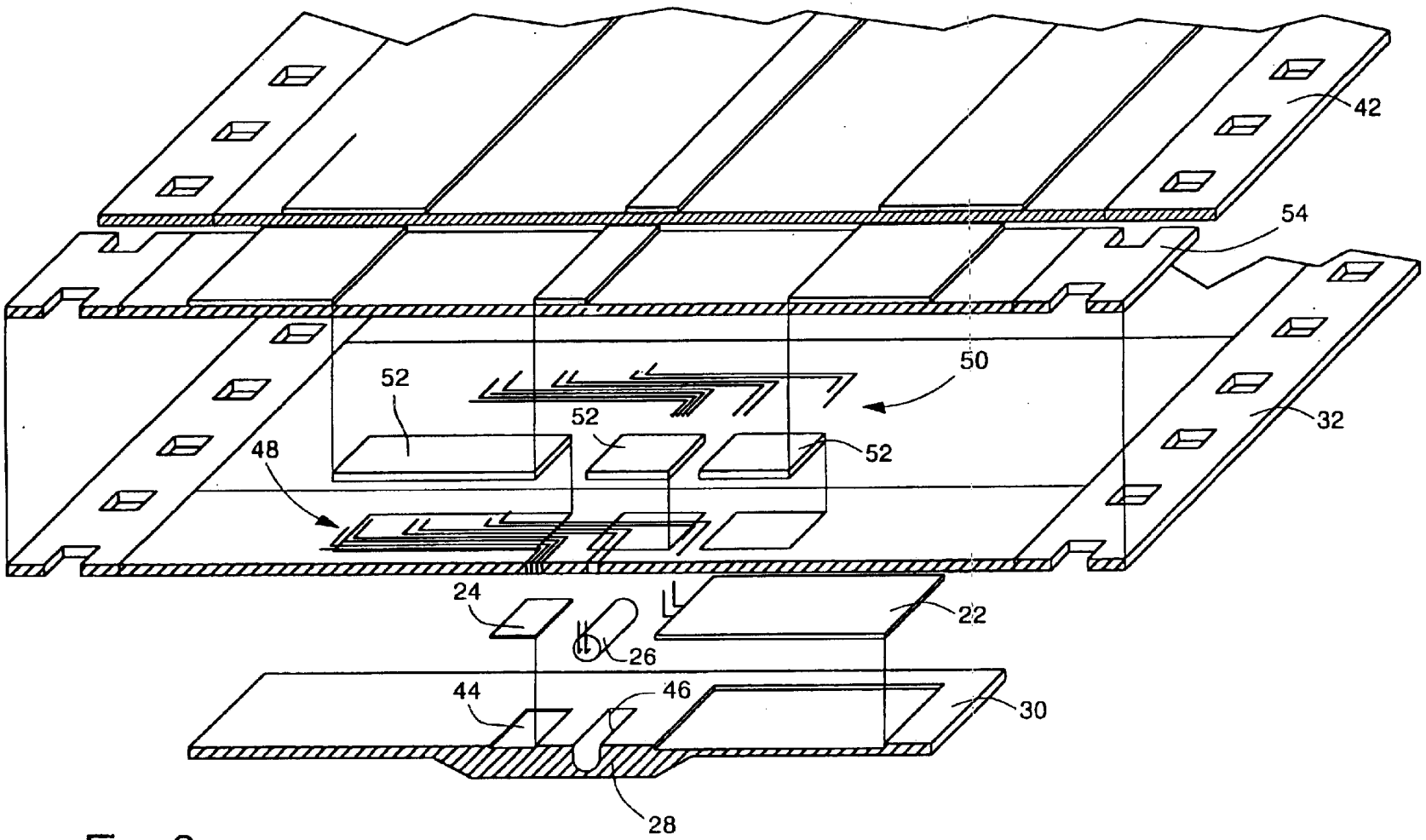
FIG. 3 is a perspective view of the different layers forming the watch of FIG. 1 in the dissociated state.

FIG. 3 is a perspective view of the dissociated state of the different layers forming wristwatch 1 according to the present invention. Examining the Figure from the top to the bottom, it shows first of all reinforcing layer 30 which has, locally, an overthickness of material forming receptacle 28 in the inner cavity of which are arranged integrated circuit 24 and quartz resonator element 26. As can be seen in the figure, and according to an alternative embodiment of the invention, receptacle 28 has recesses 44 and 46 which are fitted, in shape and in dimensions, to the geometry of integrated circuit 24 and resonator 26 respectively. As in the preceding figure, electric power source 22 is a flat battery, for example a lithium battery, arranged in the thin portion of reinforcing layer 30. It will be noted that integrated circuit 24, quartz resonator 26 and battery 22 touch the top surface of reinforcing layer 30. Consequently, this reinforcing layer 30 has a perfectly plane and regular contact surface on which printed circuit 32 will be able to be laminated without any difficulty. This constitutes a very important advantage with respect to the prior art. Indeed, in the embodiments of the prior art in which the different watch components are arranged in the thickness of the wristband, empty spaces appear between these components. Consequently, the layer or film which is then laminated on the components will only be in partial contact with the latter. This results in less stability for the mechanical connection between the layer or film and these components. The aforecited flexible printed circuit 32 is then laminated on reinforcing layer 30. Sets of conductive paths 48 and 50 are deposited on printed circuit 32. These conductive paths 48 and 50 allow integrated circuit 24, quartz resonator element 26 and electric power source 22 to be connected to each other. Display cells 20 are constituted by selective depositions 52 of electronic ink. As explained previously, the control electrodes of display cells 20 are directly deposited on top face 36 of printed circuit 32. The counter-electrodes are not directly printed onto the layers of electronic ink 52, but carried by the bottom face of a transparent film 54 which covers these ink layers. The control electrodes and the counter-electrodes have not been shown to avoid overloading the drawing unnecessarily. Finally, protective layer 42, which can carry, if required, decorative or other designs, is laminated onto the top face of transparent film 50.

FIGS. 4A to 4E show the different manufacturing steps of a watch according to the invention.

Figure 4A:
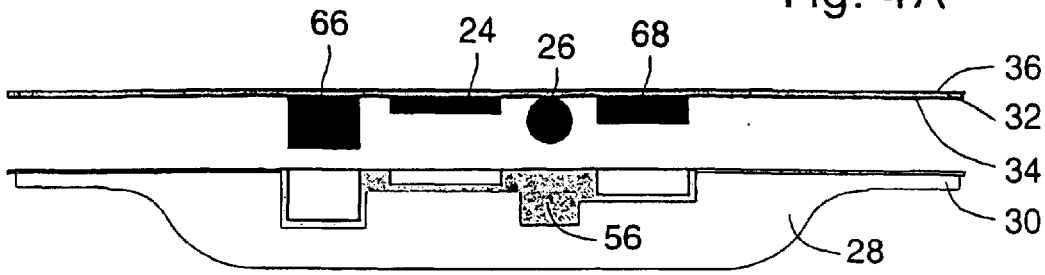
FIGS. 4A to 4E show the different manufacturing steps of a watch according to FIG. 1.

FIG. 4A shows flexible printed circuit 32 on the bottom face 34 of which are mounted the various electronic components forming wristwatch 1, namely integrated circuit 24, quartz resonator element 26 and two control circuits 66 and 68 the role of which will be explained in detail with reference to FIG. 5. The components of watch 1 are mounted on bottom face 34 of printed circuit 32 by the surface mounted device technique (SMD). Printed circuit 32 is then laminated onto reinforcing layer 30 so that the components of watch 1 are housed in the inner volume of rigid receptacle 28. It will be noted that the components are embedded in an encapsulation resin 56 such as a viscous liquid which is then put in the conditions necessary to transform it into an insulating solid adhesive material or an elastomer. There must be sufficient space between the different components of the watch and the bottom of receptacle 28 for resin 56 to be able to be inserted.

Figure 4B:
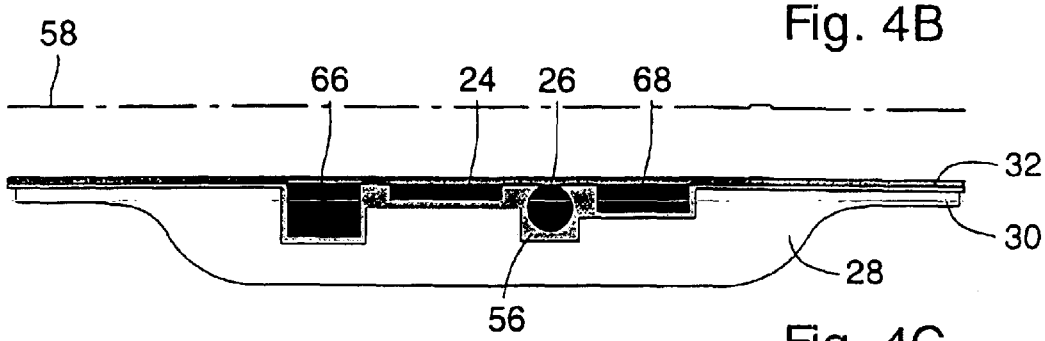

In FIG. 4B, encapsulation resin 56 has polymerised and has transformed into a solid adhesive material. An electrically conductive material 58, such as, in particular, a polymer, is deposited, for example by screen printing, onto top face 36 of printed circuit 32, to form the electric connections between the different components of watch 1, as well as the control electrodes of display cells 20.

Figure 4C:
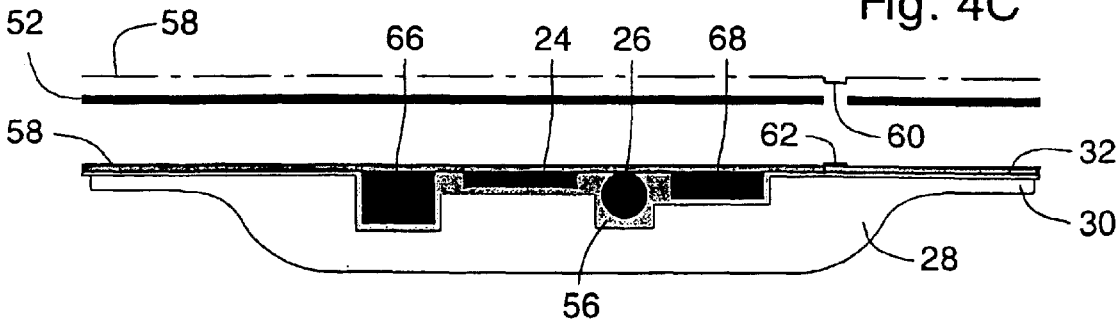

In FIG. 4C, electronic ink 52, which will form the aforementioned display cells 20, is selectively deposited, then a new layer of conductive material 58 is deposited to form the counter-electrodes of said display cells 20. The presence of two contact studs 60 and 62, which allow the electric continuity between the control electrodes and counter-electrodes to be assured, will be noted.

Figure 4D:
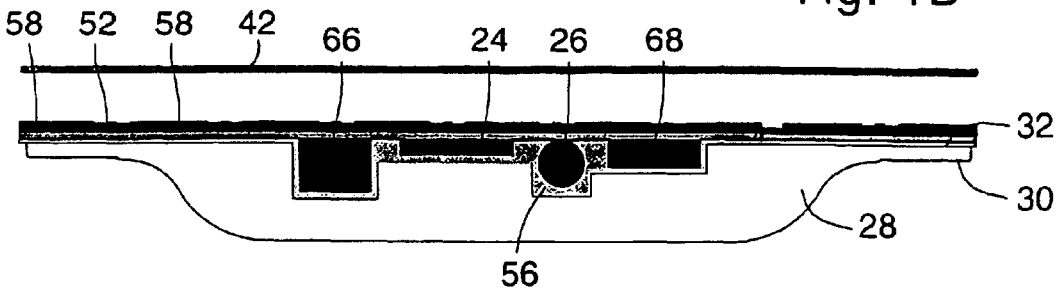

In FIG. 4D, the counter-electrodes are covered with a protective layer 42 on which a decorative element can be printed.

Figure 4E:
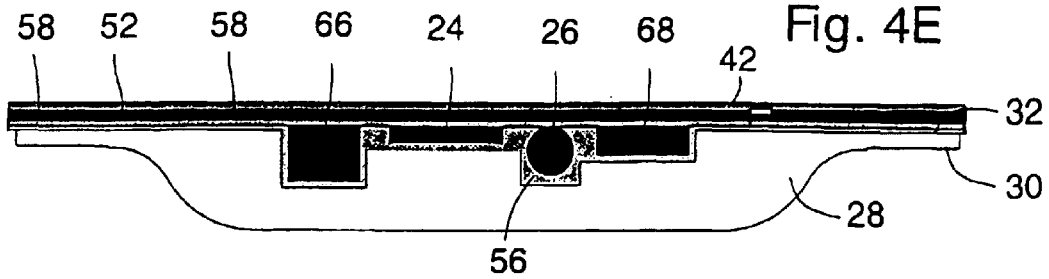

FIG. 4E shows the device according to the invention in the finished state.

Figure 5:
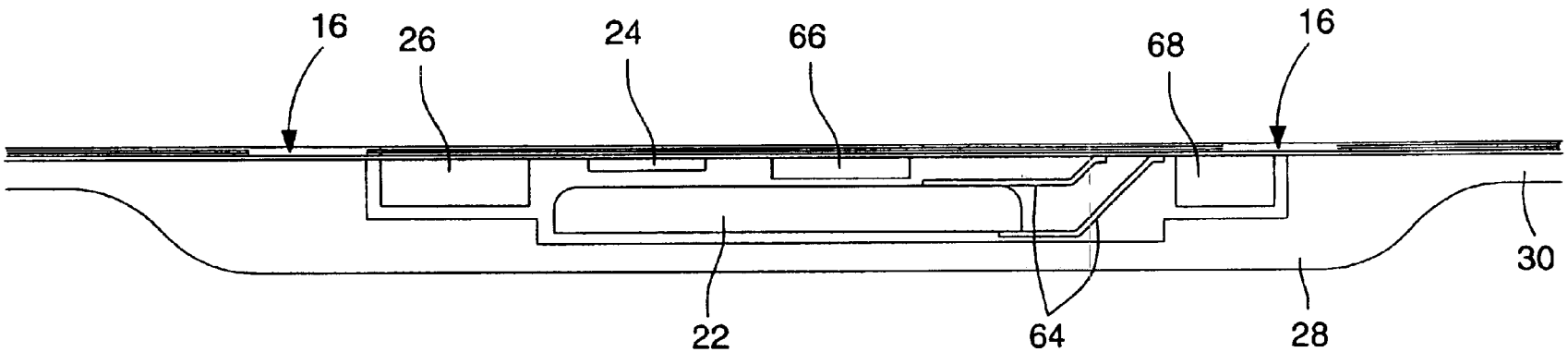
FIG. 5 shows an alternative embodiment of the wristwatch of FIG. 1.

FIG. 5 shows an alternative embodiment of wristwatch 1 according to the invention. On examining this figure, it will be noted that electric power source 22 is this time housed in the inner volume of rigid receptacle 28. This power source may be a battery or a rechargeable accumulator. In this latter case, the accumulator may be recharged from the exterior or recharged by means of a flexible solar cell arranged between display cells 20 and protective layer 42. The battery or accumulator 22 is provided with two contact strips 64 which come into electric contact with printed circuit 32. The watch shown in FIG. 5 further includes, in addition to integrated circuit 24 and quartz resonator 26 which have already been described, a first and a second control circuit respectively 66 and 68. The first control circuit 66 will be used to control the display of watch 1. Indeed, when display cells 20 are made using an electronic ink, the control thereof may require very high electric voltages, of the order of 100 volts. It is then advantageous to provide a separate control circuit from integrated circuit 24 which will then only be used to generate the information to be displayed. The second control circuit 68 is used to control touch keys 16 which are constantly live, waiting for the keys to be used by the wearer of watch 1. This solution is however uneconomical from the point of view of electric power consumption. A second solution consists in using control circuit 68 which, at regular intervals of time, will check whether the touch keys have been activated by the user or not. If control circuit 68 notes that at a given moment the user wishes to use touch keys 16, it will activate them.

Figure 8:
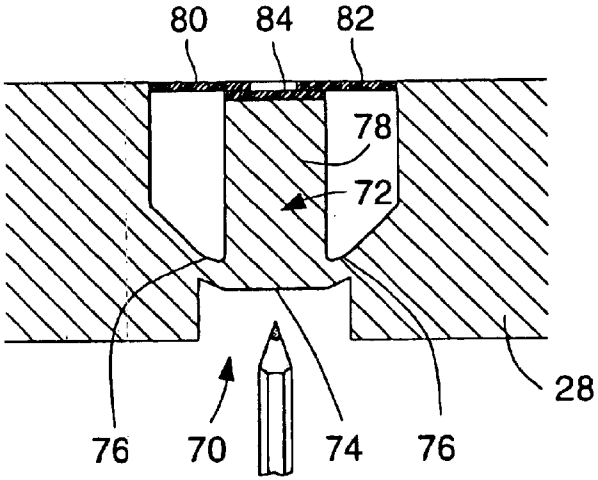
FIG. 8 is a similar view to that of FIG. 7, the push-button being activated.
Figure 7:
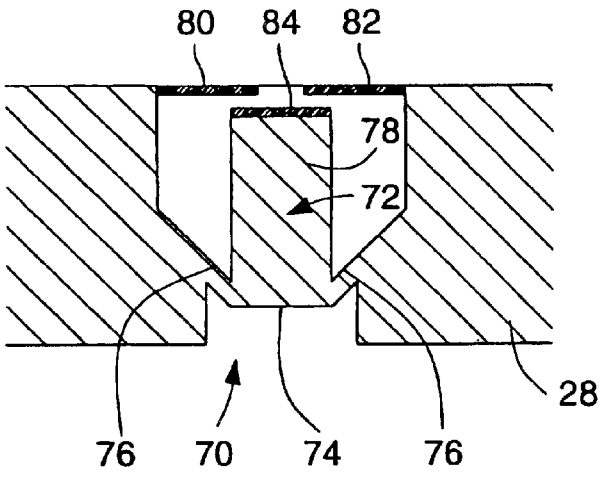
FIG. 7 is a larger scale view of the region surrounded with a circle in FIG. 6, the push-button being in the rest position.
Figure 6:
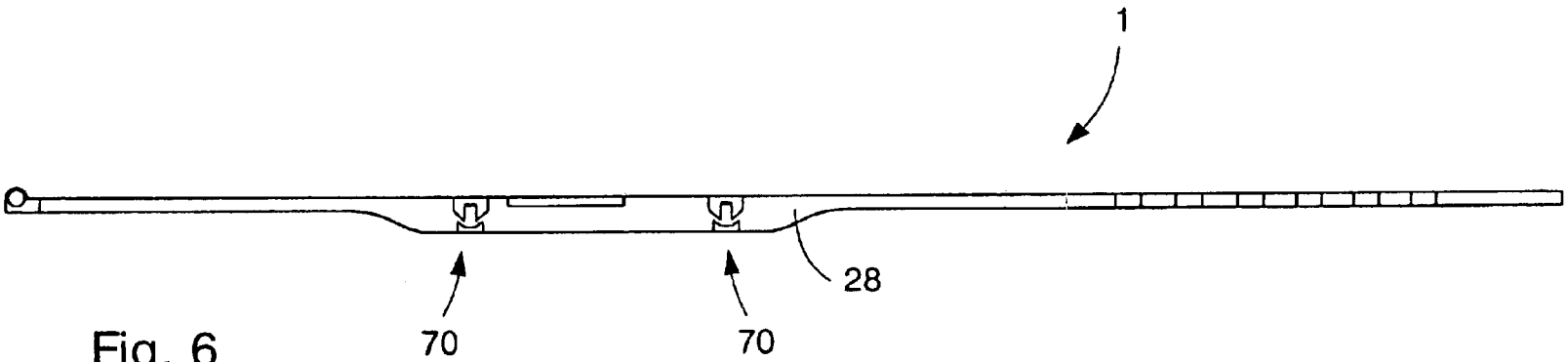
FIG. 6 is a simplified longitudinal cross-section of a watch according to the invention provided with push-buttons embedded in the thickness of the receptacle.
Figure 9:
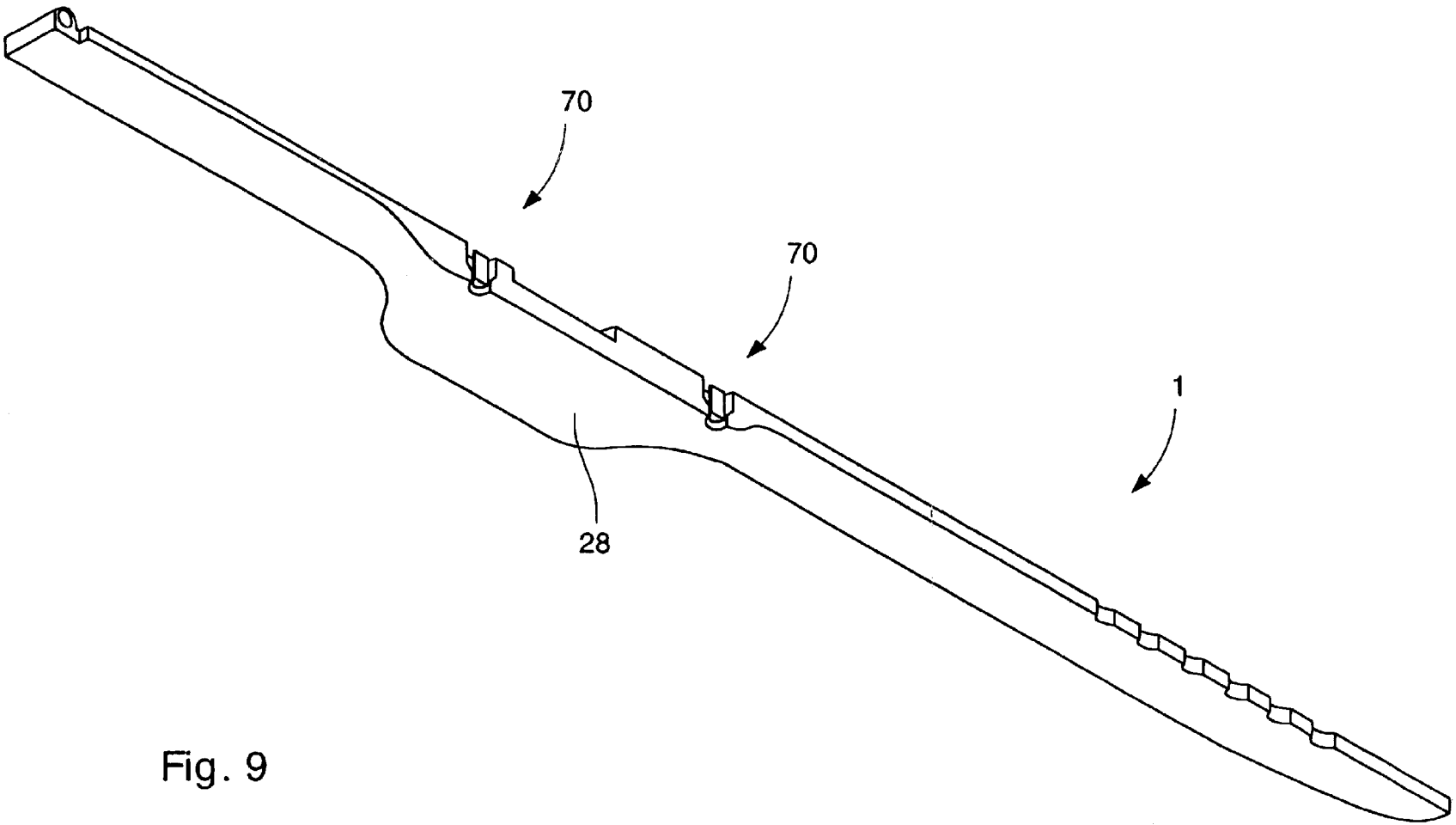
FIG. 9 is a cross-sectional and perspective view of the watch of FIG. 6.

FIG. 6 is a simplified cross-section of a watch according to the invention provided with push-buttons 70 embedded in the thickness of receptacle 28. These push-buttons 70 are identical and are each formed of a stem 72 preferably having a cylindrical, slightly conical or prismatic shape, oriented towards the interior of receptacle 28 of watch 1. As is shown clearly in FIGS. 7 and 8, end 74 of stems 72 located outside receptacle 28 is set back with respect to the surface of the bottom of said receptacle 28. Consequently, one obtains a receptacle 28 free of any projecting or protruding parts, which considerably improves the aesthetic appearance of watch 1. On the other hand, as push-buttons 70 are completely embedded in receptacle 28, the risk of inadvertently activating them is non existent. There is thus no risk of an horological function being inadvertently started, which means that battery 22 is not run down unnecessarily. Likewise, the settings of watch 1 cannot be modified without the intervention of the user who, using a pointed element such as the tip of a pen, can activate push-buttons 70.

Push-buttons 70 are made in a single piece with receptacle 28 of watch 1, which means they can be manufactured, for example by injection molding or molding a plastic material, at the same time as receptacle 28. The manufacturing costs of reinforcing layer 30 of watch 1 including push-buttons 70 made in one piece therewith, are, as will easily be understood, greatly reduced.

More precisely, stems 72 of push-buttons 70 are connected to receptacle 28 by a portion 76 which is thin enough to be slightly flexible and thus to allow a longitudinal travel of stems 72 and to act as a return spring from said stems 72. It will be noted that the return of stems 72 is assured solely by the resilience of the plastic material of which receptacle 28 is made. Consequently, it is not necessary to provide any return spring which, here again, allows a substantial reduction in the manufacturing costs.

Portion 76, via which stem 72 is connected to receptacle 28, has the shape of a circular skirt which opens towards the interior of receptacle 28 at an angle which is selected so as to give said skirt 76 the proper resilience. Skirt 76 is directly connected to receptacle 28 and completely surrounds stem 72, thus forming perfect sealing of push-buttons 70. The sealing gaskets which are usually used in conjunction with conventional push-buttons can thus be omitted, such sealing gaskets having, as is well known, the drawback of becoming dirty and hard over time, which causes less of watertightness which may be detrimental to the proper working of the watch.

On the inner side of receptacle 28, end 78 of stem 72 has a frontal surface which may have any shape suited to co-operate with electric contacts 80 and 82 connected, respectively to the positive pole of electric power source 22 and to an input of integrated circuit 24. For this purpose, the frontal surface can be metallised or accommodate a metal strip 84. Via the effect of a manual application of pressure exerted on end 74 of stem 72 located on the outer side of receptacle 28, the deformation of flexible skirt 76 drives stem 72 to travel to an active position shown in FIG. 8 in which it electrically connects the two contacts 80 and 82, which allows an instruction to be entered in printed circuit 24. When this application of pressure is released, stem 72 is returned to its rest position by the resilience of the plastic material.

According to an alternative embodiment, push-buttons 70 may also be used in conjunction with touch keys 16. An advantageous solution consists in controlling the activation and deactivation of these data input keys 16 by means of push-buttons 70. A first application of pressure on one of push-buttons 70 will make the corresponding touch key 16 live. The user may then, by means of said touch key 16, correct or modify one of the items of information processed and displayed by the portable device according to the invention. A second application of pressure on the same push-button 70 will then deactivate touch key 16 again.

It goes without saying that the present invention is not limited to the embodiment which has just been described and that modifications and simple variants may be envisaged without departing from the scope of the invention.

What is claimed is:

1. An electronic device for generating and displaying an item of information, including a flexible body, an electronic unit for generating the information, and comprising at least one integrated circuit, suited to the type of information to be elaborated and displayed, and a time base circuit formed by a quartz resonator element and a frequency divider, as well as counters which supply the integrated circuit with time-related information in response to signals supplied by the time base circuit, at least a display cell for displaying said information, and an electric power source for powering the electronic unit, wherein the flexible body has, at at least one location on its length, an overthickness of material forming a rigid receptacle in the inner cavity of which is arranged said electronic unit, the flexible body comprising a flexible reinforcing layer forming a bottom, of the electronic device, in which is arranged the rigid receptacle accommodating the electronic unit and the electric power source, and the integrated circuit, quartz resonator and electric power source touching a top surface of the reinforcing layer.

2. An electronic device according to claim 1, wherein the electronic unit and the electric power source, arranged in the rigid receptacle of the flexible body, are embedded in an encapsulation resin which is put into the conditions necessary for it to transform into a solid insulating adhesive material.

3. An electronic device according to claims 1, wherein the flexible body is made of at least one of the following flexible materials: cardboard, paper or plastic.

4. An electronic device according to claim 3, wherein the flexible body includes at least one of the following flexible plastic materials: ABS, polyamide, polycarbonate, polyester, polyethylene terephtalate, polyimide, polypropylene, polyurethane or silicon.

5. An electronic device according to claim 1, wherein the electronic unit includes, in addition to the integrated circuit intended to elaborate the information to be displayed, at least a control circuit intended to control the display cell.

6. An electronic device according to claim 1, wherein the electric power source is a battery or a rechargeable accumulator.

7. An electronic device according to claim 6, wherein the accumulator is recharged from the exterior of said electronic device.

8. An electronic device according to claim 6, wherein the accumulator is recharged by a flexible solar cell.

9. An electronic device according to claim 1, wherein the display cell includes at least one liquid crystal cell.

10. An electronic device according to claim 9, wherein the liquid crystal cell includes two plates which delimit it and which surround the liquid crystal layer, these two plates being formed by thin films of flexible plastic material.

11. An electronic device according to claim 10, wherein the liquid crystal cell is of the PDLC type.

12. An electronic device according to claim 9, wherein the liquid crystal cell is formed by a layer of electronic ink formed by capsules which are dispersed in a binding material and which enclose a liquid crystal material.

13. An electronic device according to claim 1, wherein it includes means for manually modifying the information to be displayed.

14. An electronic device according to claim 13, wherein the means for manually modifying the information to be displayed includes at least one touch key.

15. An electronic device according to claim 14, wherein the touch key is controlled by a control circuit which belongs to it and which checks, at regular intervals of time, whether said touch key has been activated by the user.

16. An electronic device according to claim 14, wherein it includes at least one push-button which controls the activation and deactivation of the touch keys.

17. An electronic device according to claim 1, wherein the display cell is of the electrophoretic type.

18. An electronic device for generating and displaying an item of information, including a flexible body, an electronic unit for generating the information, at least a display cell for displaying said information, and an electric power source for powering the electronic unit, wherein the flexible body has, at at least one location on its length, an overthickness of material forming a rigid receptacle in the inner cavity of which is arranged said electronic unit, wherein the flexible body includes in succession a flexible reinforcing layer forming a bottom, of the electronic device, in which is arranged the rigid receptacle for accommodating the electronic unit, a flexible printed circuit having a bottom face and a top face respectively turned towards the reinforcing layer and towards the top of the electronic device, the electronic unit and the electric power source being secured to the bottom face of the flexible printed circuit, while the display cell is arranged on the top face of said flexible printed circuit, and a flexible protective layer covering the flexible printed circuit.

19. An electronic device according to claim 18, wherein the printed circuit is secured to the reinforcing layer by means of a thin film of adhesive or by means of a thin layer of liquid adhesive material, and in that the protective layer is bonded or hot pressed onto the flexible printed circuit.

20. An electronic device for generating and displaying an item of information, including a flexible body, an electronic unit for generating the information, at least a display cell for displaying said information, and an electric power source for powering the electronic unit, wherein the flexible body has, at at least one location on its length, an overthickness of material forming a rigid receptacle in the inner cavity of which is arranged said electronic unit, wherein said device includes means for manually modifying the information to be displayed, wherein the means for manually modifying the information to be displayed includes at least one touch key, wherein said device includes at least one push-button which controls the activation and deactivation of the touch keys, and wherein the push-button, arranged towards the interior of the rigid receptacle of the reinforcing layer, is made in a single piece with said receptacle and is set back with respect to the outer surface of the latter.

21. An electronic device according to claim 20, wherein the push-button includes a stem connected to the receptacle by a flexible portion which exerts a resilient return force on the stem.

22. An electronic device according to claim 21, wherein the flexible portion has the shape of circular skirt which is directly connected to the receptacle and completely surrounds the stem.

* * * * *